US006739224B1

(12) United States Patent
Wershe

(10) Patent No.: US 6,739,224 B1
(45) Date of Patent: May 25, 2004

(54) MULTI-FUNCTION PORTABLE TOOL

(75) Inventor: Richard Wershe, 22316 Harper, St. Clair Shores, MI (US) 48080

(73) Assignee: Richard Wershe, St. Clair Shores, MI (US)

( * ) Notice: Subject to any disclaimer, the term of this patent is extended or adjusted under 35 U.S.C. 154(b) by 0 days.

(21) Appl. No.: 09/904,410

(22) Filed: Jul. 12, 2001

Related U.S. Application Data

(60) Provisional application No. 60/241,310, filed on Oct. 18, 2000, provisional application No. 60/219,290, filed on Jul. 19, 2000, and provisional application No. 60/217,561, filed on Jul. 12, 2000.

(51) Int. Cl.[7] ..... B25E 1/00

(52) U.S. Cl. ..... 81/437; 7/138; 81/121.1; 81/177.4; 81/490

(58) Field of Search ..... 81/437, 490, 9.24, 81/121.1, 124.4, 124.5, 177.1, 177.4, 489; 7/138, 118, 165

(56) References Cited

U.S. PATENT DOCUMENTS 4,560,344 A * 12/1985 Kietaibl ..... 431/253
4,811,637 A * 3/1989 McCleary ..... 81/177.2
4,926,721 A * 5/1990 Hsiao ..... 81/177.4
4,934,223 A * 6/1990 Wong ..... 81/177.4
5,186,083 A * 2/1993 Hsiao ..... 81/124.4
5,303,439 A * 4/1994 Seals ..... 7/138
5,421,225 A * 6/1995 Chen ..... 81/490
5,499,562 A * 3/1996 Feng ..... 81/177.4
5,553,340 A * 9/1996 Brown, Jr. ..... 7/118
5,896,606 A * 4/1999 Huang ..... 7/165
5,911,799 A * 6/1999 Johnson et al. ..... 81/177.4
5,916,341 A * 6/1999 Lin ..... 81/437
5,931,061 A * 8/1999 Kuo ..... 81/490
6,062,111 A * 5/2000 Wershe ..... 81/177.4
6,112,351 A * 9/2000 Hawkins et al. ..... 81/437
6,151,997 A * 11/2000 Lin ..... 81/177.4
6,186,036 B1 * 2/2001 Huang ..... 81/490
6,286,397 B1 * 9/2001 Taggart et al. ..... 7/118

* cited by examiner

*Primary Examiner*—Hadi Shakeri
(74) *Attorney, Agent, or Firm*—Reising, Ethington, Barnes, Kisselle, P.C.

(57) ABSTRACT

A multifunction tool (10) has a body with an elongated section (15) with tool chuck (18) mounted at the end. The tool chuck has a square exterior (135) and hex shaped interior (139) for both mounting and storing a socket tool (137) and also holding a bit when the socket tool is stored. The body also has a cavity (76, 110, 166) for storing an elongated tool along the elongated section. The bottom of the handle has a blade sharpener (86) or a bottle opener (150) built therein.

20 Claims, 6 Drawing Sheets

MULTI-FUNCTION PORTABLE TOOL

This application claims benefit of Provisional Appls. No. 60/217,561 filed Jul. 12, 2000, Prov. Appl. No. 60/219,290 filed Jul. 19, 2000 and Prov. Appl. No. 60/241,310 filed Oct. 18, 2000.

TECHNICAL FIELD

The field of this invention relates to hand tools and more particularly to a hand held portable tools with storage capabilities.

BACKGROUND OF THE DISCLOSURE

Outdoor individual sports have enjoyed an increase in popularity. Many of these sports require portable equipment such as archery bows, in-line skates, or skateboards that may need maintenance or repair on the spot. A tool is often necessary for properly maintaining or repairing the equipment. Often, maintenance of the outdoor equipment requires only a tightening of a bolt or nut. For many pieces of equipment, one end of an axle or bolt needs to be held while a nut or connected piece at an opposite end needs to be turned.

What is needed is a convenient portable tool that can be used to engage both ends of an axle, nut assembly or similar item for an outdoor sports equipment and be able to loosen and tighten the axle pins, nuts, bolts and other threaded fasteners on outdoor equipment. What is generally needed is a portable pocket tool that can have multiple uses for repairing and maintaining sports equipment while still being conveniently stored.

SUMMARY OF THE INVENTION

A hand held tool has a main body with a handle section and a rotatable tool chuck operably attached to the body at an distal end of a longitudinally extending section of the main body from the handle section. The hand held tool includes a receiving cavity in the main body for removably receiving and storing a tool thereon where the tool extends besides the longitudinally extending section toward the tool chuck.

Preferably, the receiving cavity is in the form of a hole for receiving an allen wrench therethrough. In addition, the main body preferably has the tool chuck mounted at a distal end of the longitudinally extended section and said handle section being transverse to the longitudinally extended section. The receiving cavity is preferably in the form of a hole extending along the longitudinally extended section for receiving a long section of an allen wrench and an elongated recess for receiving a short section of said allen wrench.

The handle preferably also has a hollow interior for storing tools therein and the hole extends to said hollow interior for providing the allen wrench to extend through said storage hollow interior when in the stored position. In another embodiment, the receiving cavity is shaped to receive and store a flat wrench tool along the main body. Preferably the flat wrench tool has a bottle opener built into it. In another embodiment, the flat wrench tool has a cavity therein with a saw blade edge. In another embodiment, the bottle opener is built into the handle section of the main body.

In one embodiment the handle has a star shaped recess for storing a tool bit with at least one ear extending from its side to act as a stop when received into an aperture in the wrench to allow the wrench to apply pressure on the bit.

In accordance with another aspect of the invention, the chuck has an outer wall that has a configuration in cross section for operably mounting a socket tool in a working position or a storage position. The chuck has an inner wall surface with a configuration in cross section for operably receiving a tool bit when the socket tool is in said storage position. Preferably, the handle section has additional cavities for receiving and storing socket members.

Preferably, the handle member has an extension pivotably attached thereto for pivoting outwardly and providing extra torque turning ability to the handle. The handle may have a blade sharpener built into an end thereof.

In accordance with another aspect of the invention, a hand held tool has a main body with a handle section and a cavity therein for receiving tools therein. The main body includes two halves that are connected together for storing tools and separable for providing access to the tools and being operably used as a handle for the tools.

In accordance with another aspect of the invention, a hand held tool has a tubular shaped main body section with a bit storably mounted on tubular body. The tubular body has a receptor for receiving a tool bit in an operating position with the tubular body being used as a operable handle for said tool. The tubular body is stepped with a larger end and smaller end. The flat wrench member is sized to fit within the tubular body and has a large end stepped to not intrude into the small end of the tubular body.

A stop member is attachable to the larger end of the tubular body for retaining the flat wrench within the tubular body. In one embodiment, the top member is a resilient spring key ring member. In another embodiment, the stop member is a cap member attachable to the larger end of said tubular body for retaining the flat wrench within the tubular body. A socket member is stored in said tubular member between the wrench member and the cap member. The flat wrench member has a cavity for retaining at least one bit therein when stored within the tubular body.

Preferably, the tubular body has opposing slots at and end thereof for receiving the larger end of said flat wrench member during storage and having slots at a mid section thereof for receiving a narrower section of the flat wrench member during usage thereof to function as an operable handle member.

BRIEF DESCRIPTION OF THE DRAWINGS

Reference now is made to the accompanying drawings in which.

DETAILED DESCRIPTION OF THE PREFERRED EMBODIMENT

Figure 1:
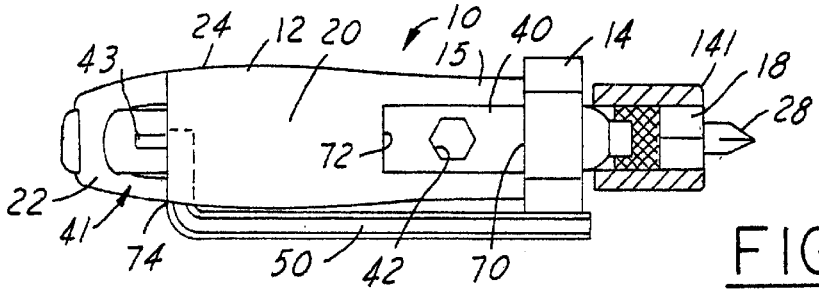
FIG. 1 is a top plan view of one embodiment according to the invention.
Figure 2:
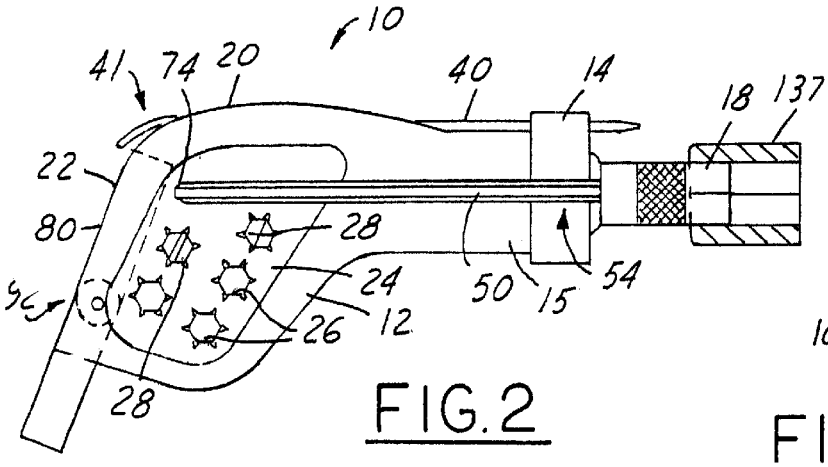
FIG. 2 is side elevational view of the embodiment shown in FIG. 1.
Figure 4:
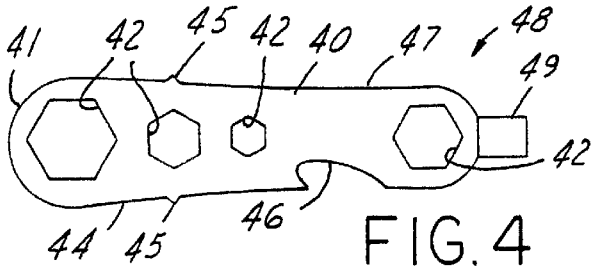
FIG. 4 is a plan view of the wrench tool shown in FIG. 1.
Figure 5:
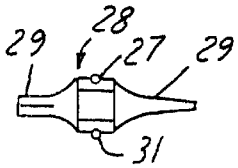
FIG. 5 is a side view of a double ended tool bit shown in FIG. 2.

Referring now to FIGS. 1 and 2, a main body of a portable tool assembly 10 of a ratchet tool has a handle 12, an integral collar 14 with the handle 12, and a rotatable attached tool chuck 18 at the distal end of a longitudinally extended section 15. The handle 12 has major sides 24 and a plurality of tool bit storage recesses 26 disposed therebetween for storage of tool bits 28. One or more recesses 26 may be star-shaped. The tool bits 28 may be double ended as shown in FIG. 5 where each bit end 29 is desirably shaped and a middle section 27 is hex-shaped with two ears 31 on opposing corners. The ears can be accommodated when in storage by the star shaped storage recesses 26. In addition, the handle 12 may incorporate various other apertures to removably receive elongated tools such as an allen wrench or a flat specialty tool such as the one shown in FIG. 4 that extend along the elongated section 15. These elongated tools may then be removed and used simultaneously with the ratchet so that each side of a fastener may be engaged.

Figure 3:
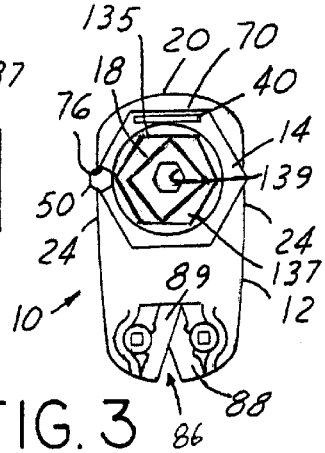
FIG. 3 is front elevational view of the embodiment shown in FIG. 1.

More specifically, FIGS. 1–3 show an embodiment which incorporates an elongated tool 40 and a 90° allen wrench 50. The elongated tool 40 has a plurality of hexagonal apertures 42 adapted to engage an end of a fastener (not shown). The tool 40 is stored in slots 70 and 72 located in an edge side 20 of the handle 12 and collar 14, respectively, with the end 41 proximate a rear edge side 22. The elongated tool 40, which is a stamped piece of metal, has a plurality of hexagonal apertures 42 therethrough adapted to engage the end of various sized fasteners. One of the hexagonal apertures 42 is sized to snugly receive bit 28 and be held as a handle. The ears 31 provide a stop for the bit and pressure can be applied on the bit by the wrench. As shown in FIG. 4, one edge 44 of the elongated tool 40 includes a half-heart-shaped notch 46 that is adapted to be used as a bottle opener. One end 48 of the elongated tool 40 includes a tapered flange 49 that is adapted to co-act with a slotted head of a screw. The flange 49 can also be used to remove the bits 28 from recesses 26. Each edge 47 has a protrusion 45 which engages the sides of slot 72 and prevents the tool 40 from being stuck in the slots.

The handle 12 has an aperture 74 proximate to the storage recesses 26. The collar 14 has a groove 76 on the same side as one of the major sides 24. The short end 52 of the 90° allen wrench 50 is inserted into the aperture 74 and the long end 54 is snapped into the groove 76 for storage. Both the elongated tool 40 and the alien wrench 50 can be removed from the portable tool 10 and used simultaneously with the ratchet tool.

Furthermore, the chuck 18 has an outer surface 135 shaped to be received in a drive-end hole 141 of an annular socket tool 137. As shown, the outer surface 135 of the chuck 18 is generally square to fit in the drive end hole 141 that is complimentary shaped. The interior 139 of the chuck is generally hex-shaped to receive a tool bit. With this construction, the socket tool 137 may be mounted on the chuck for use of the socket tool, as shown in FIG. 2, or, the socket tool may be removed from the chuck, flipped end for end, and received on the chuck for storage with the drive end 141 of the socket tool 137 generally flush with an end 143 of the chuck 18, as shown in FIG. 1. With the socket 137 in its stored position (FIG. 1) or removed, a tool bit 28 may be received in the interior cavity 139 of the chuck 18. The socket tool 137 has a conventional shaped socket 143 of a hex-shape (as shown) or other conventional shape known or desired to an engineer skilled in the art.

FIG. 2 also depicts an optional fold out handle extension 90. The rear edge side 22 of the handle 12 has an elongated cavity 80 that corresponds to the shape of the extension 90. One end 92 of the extension 90 is pivotally attached to an end of the elongated cavity 80 so that the extension 90 may be rotatably moved between a stored position within the cavity 80 and an extended position. While in the extended position, the extension 90 provides added length to the end of the handle 12 which permits the user to impart more torque when turning the ratchet than would be otherwise possible without the extension. This feature can be very useful when attempting to break free fasteners which are stuck.

A blade sharpener 86 is disposed at the distal bottom end of the handle. As best seen in FIG. 3, the blade sharpener preferably comprises a pair of inclined surfaces 88,89 defining a "V" in which a blade may be slidably received to sharpen an edge of the blade. The surfaces 88,89 are preferably formed by pieces of tungsten carbide or other suitable metals.

Figure 6:
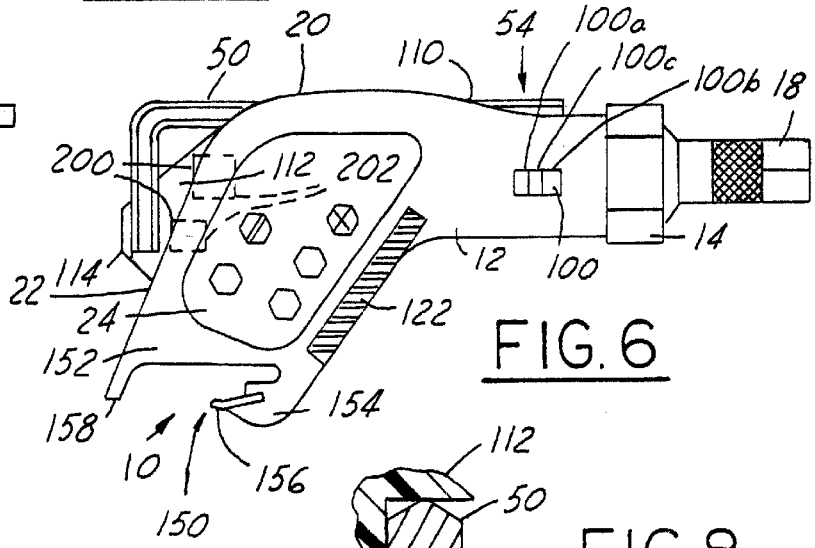
FIG. 6 is a side elevational view of a second embodiment of the invention.

As best seen in FIG. 6, the handle 12 has a selector 100 having three operational positions. When the selector 100 is in a first position 100*a*, the chuck 18 can only rotate in a clockwise direction. When the selector 100 is in a second position 100*b*, the chuck 18 can only rotate in a counter-clockwise position. When the selector 100 is in a third (middle) position 100*c* the chuck 18 cannot be rotated relative to the handle 12. Thus, the portable tool assembly 10 can act as a ratchet-type wrench or a screwdriver.

Figure 7:
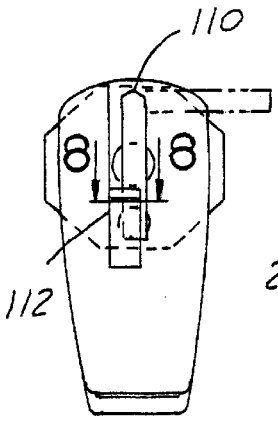
FIG. 7 is a rear plan view of the embodiment shown in FIG. 6.
Figure 8:
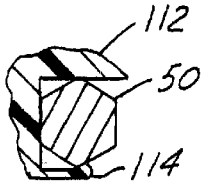
FIG. 8 is a cross-sectional view taken along line 8—8 shown in FIG. 6.

FIGS. 6–8 show an alternative way of storing an alien wrench 50 in the handle 12. The edge side 20 of the handle 12 has an aperture 110 therethrough while the rear edge 22 has a Range 112 having a clip 114. In order to store the allen wrench 50, the long end 54 is inserted into the aperture 110 and the short end 52 is rotated toward the open side of groove with detent 114 and snapped into place. Thus, the allen wrench 50 is securely retained in the handle 12 of the ratchet tool. A major side 24 of the handle 12 may also incorporate a slotted recess 120 adapted to receive a file 122. The file 122 can be used, for example, for filing burrs that can be found an a worn surface of a snow board.

In addition, the handle 12 has a bottle opener 150 located at a lower portion 152 of the handle 12. The opener 150 has a claw 154 which includes a metal inset 156 that is adapted to engage the underside of a bottle cap. The bottle opener 150 also includes a flange 158 opposite the claw 154 that is adapted to contact the top of the bottle cap when the metal insert 156 is positioned appropriately on the bottle cap during removal of the cap from the bottle.

Furthermore, a plurality of sockets 200 may be stored in apertures 202 in the rear edge 22 of the handle 12. The sockets 200 may either be affixed in the apertures 202 so that the handle 12 may be used to turn the socket 200 or they may be removably stored therein.

The chuck 18 by having a square outer wall may centrally located on the chuck adapted to receive a wrench, allows additional torque to be applied to fasteners that are particularly stuck. It is also to be noted that several threaded fasteners 208 may be stored in recesses on the major sides 24 of the handle 12.

Figure 9:
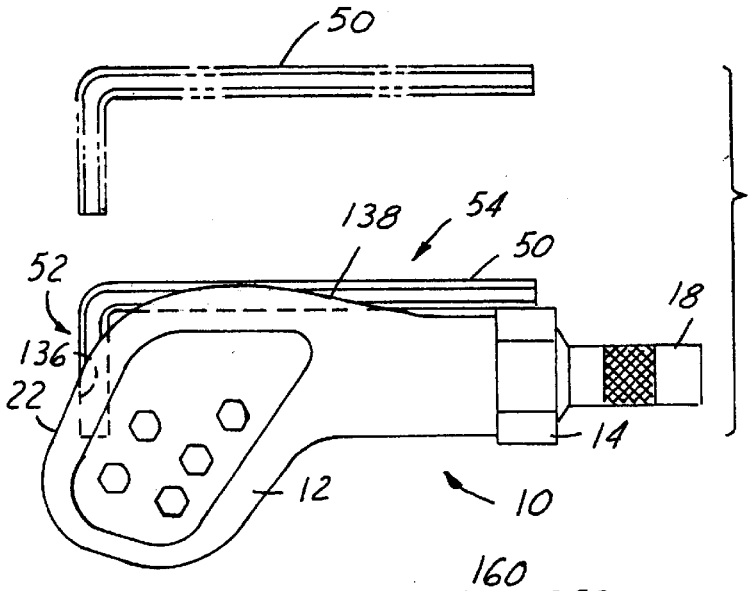
FIG. 9 is a side elevational view of a third embodiment of the invention.
Figure 10:
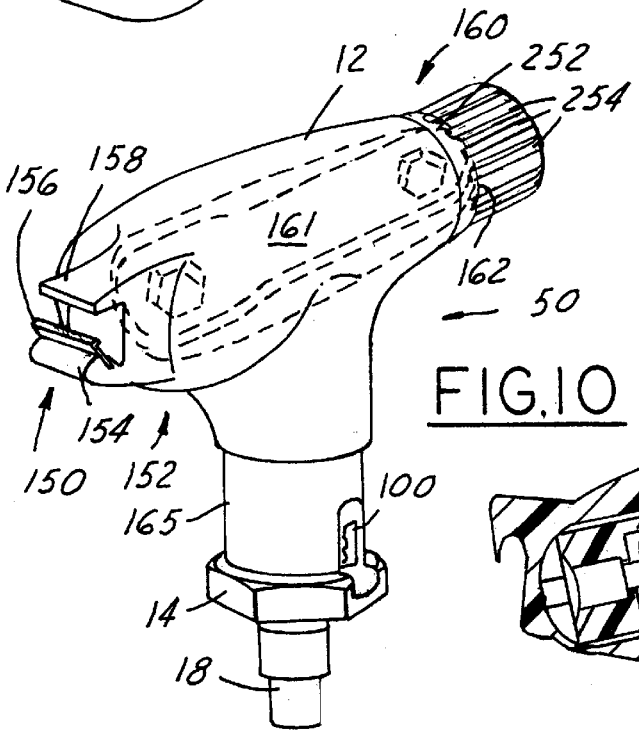
FIG. 10 is a rear perspective view of a fourth embodiment of the invention.
Figure 11:
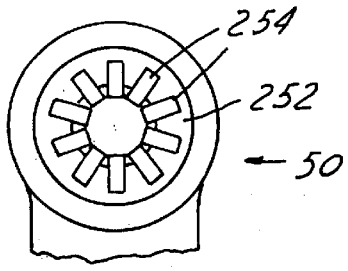
FIG. 11 is an end view of a cap of tool shown in FIG. 10.
Figure 12:
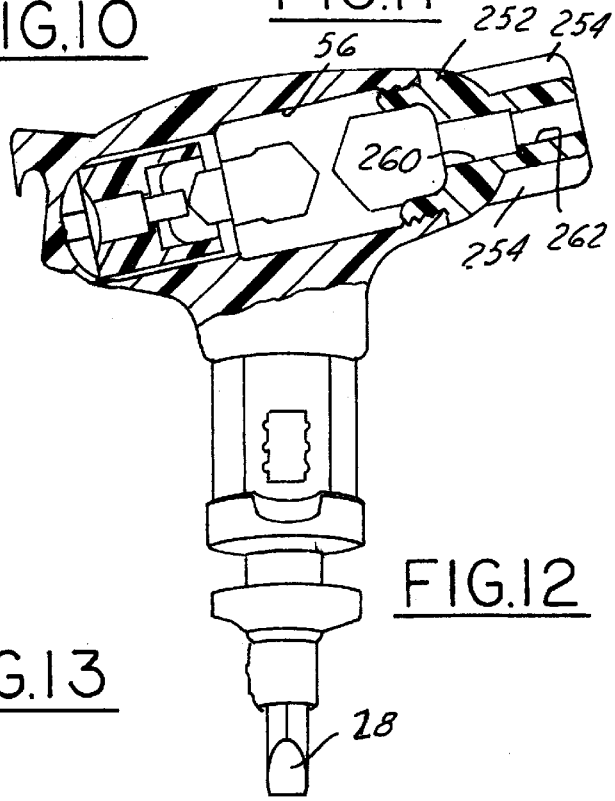
FIG. 12 is a fragmentary sectional view illustrating an interior cavity in the tool shown in FIG. 10.
Figure 13:
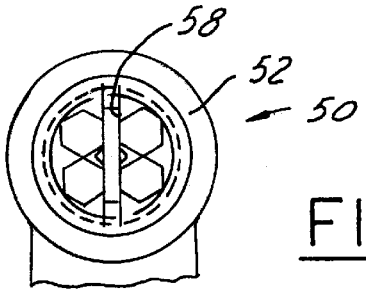
FIG. 13 is an end view of the tool shown in FIG. 4 illustrating the interior surface of the cap.
Figure 14:
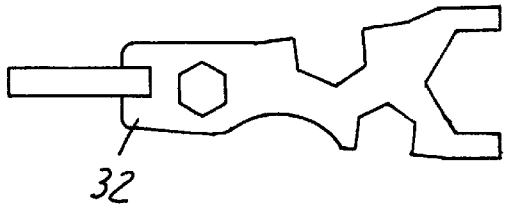
FIG. 14 is a top view of another modified specialty tool used with and stored on a tool according to the above mentioned embodiments of the invention.
Figure 15:
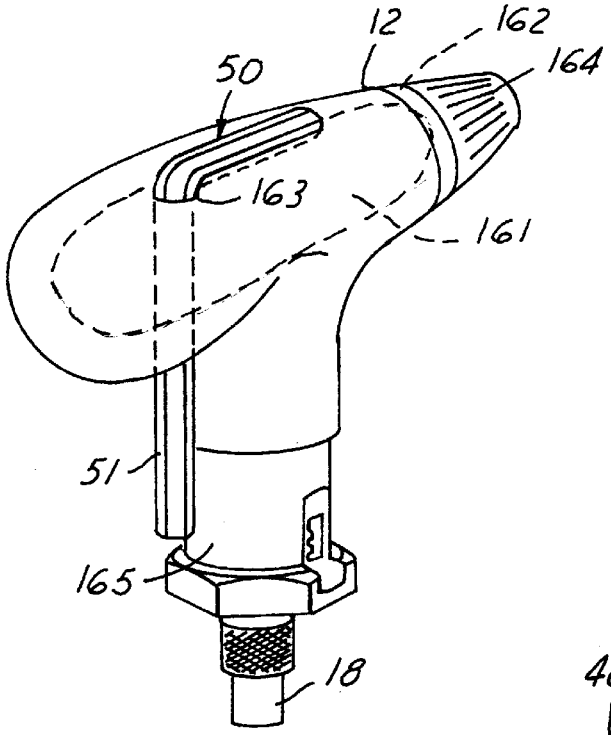
FIG. 15 is another variation of the embodiment shown in FIG. 10.

A further modification is shown in FIG. 9. The handle 12 includes aperture 136 which is oriented at the rear edge 22 and generally perpendicular to the edge side 20. The edge side 20 has a groove 138 with side walls that have detents adapted to retain the allen wrench 50. The short end 52 of the wrench 50 is inserted into the aperture 136 until the long end 54 snaps into the groove 138 in the edge side 20.

Figure 16:
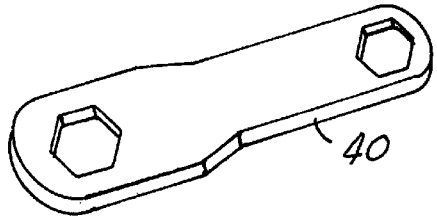
FIG. 16 illustrates a wrench tool that may fit in the interior of the handle of either embodiment shown in FIG. 10 or 15.

In a further modification, FIGS. 10–15 depict an embodiment of the ratchet tool with a T-shaped main body forming a hollow handle 12 with hollow interior 161. It may have a bottle opener 150 as previously described at one end of the handle 12. The hollow handle 12 is adapted to store bits that can be used with the chuck 18 and to store elongated tools or other allen wrenches or other types of wrenches, for example the wrench as those shown in FIG. 16. The hollow handle 12 has one end 160 with an access opening 162 that is threaded. A threaded cap 164 is adapted to co-act with the threaded opening 162 to close off the hollow interior 161 and retain the contents therein.

The cap 164 has outwardly extending ribs 254 constructed to provide an easy to grip cap to facilitate removing the cap from the tool. With the cap 164 removed, a plurality of tool bits, sockets and/or wrenches or specialty tools may be accessed from an interior cavity 161 of the tool 10. Additionally, the cap 164 preferably has an elongated slot 258 (FIG. 13) formed therein to received a flat, wrench or specially tool which may be used to engage one side of a fastener. Further, cavities 260, 262 in the cap 164 are constructed to receive a tool bit to engage one side of a fastener.

Alternately, the alien wrench 50 may extend through a hole 163 in the handle 12 and have its lower sections 51 extend longitudinally along the chuck receiving section 165. The allen wrench 50 may pass through the hollow interior 161.

Figure 18:
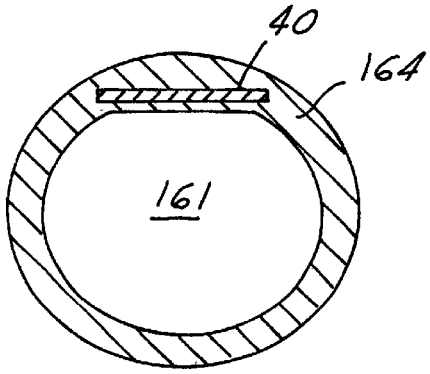
FIG. 18 is a cross-sectional view taken along line 17—17 shown in FIG. 17.
Figure 17:
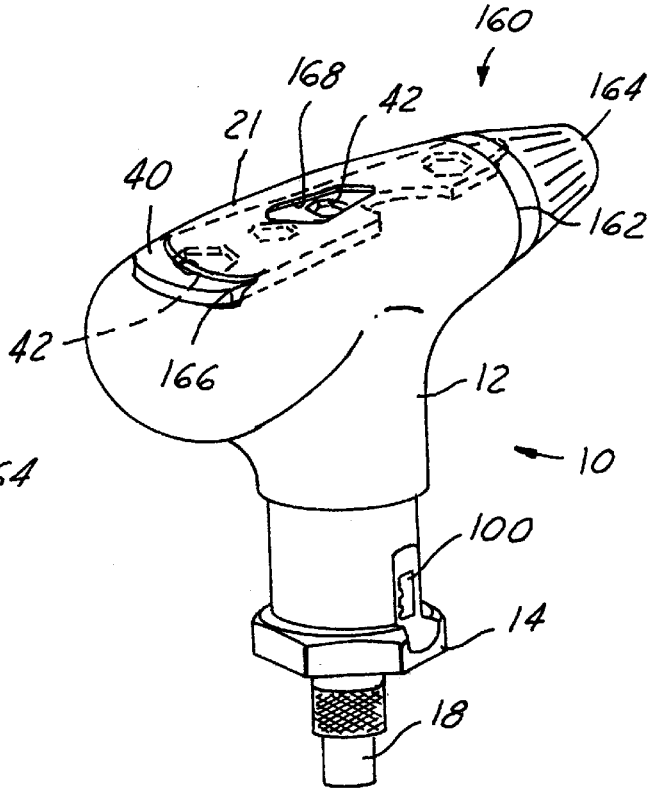
FIG. 17 is a rear perspective view of another variation of the invention.

In an embodiment shown in FIGS. 17 and 18, an elongated tool 40 is stored on the outside of the handle 12 and also acts to secure the cap 164 in place when the elongated tool 40 is in the stored position. A top side 21 of the handle 12 opposite the chuck 18 has a slotted aperture 166 adapted to receive the elongated tool 40. The top side 21 also includes an access hole 168 that provides access to the elongated tool 40 when in the stored position so as to facilitate removal of the tool 40 from the handle 12.

Figure 19:
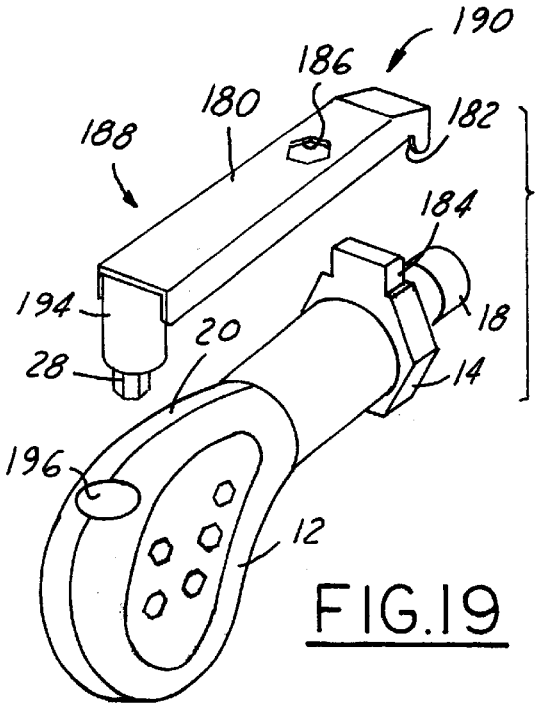
FIG. 19 is a partially exploded rear perspective view of another variation of the invention.
Figure 20:
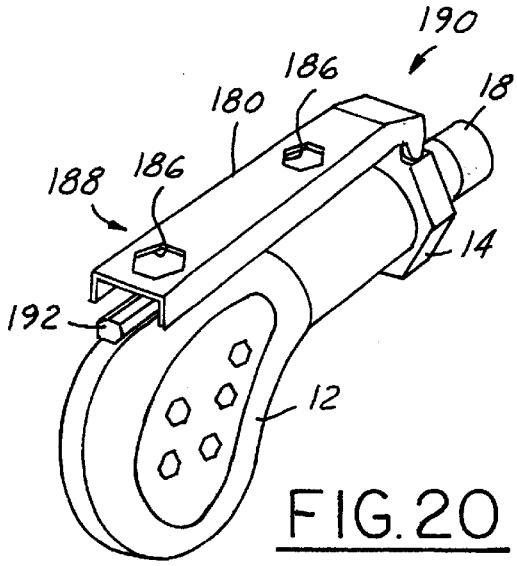
FIG. 20 is a rear perspective view of FIG. 17 fully assembled.

In yet another modification of the invention, shown in FIGS. 19 and 20, the collar 14 includes a block 15 to which an elongated tool 180 is pivotally attached. The elongated tool 180 may be attached by means of a pin, or preferably, a pair of opposing detents 182 which snap into a pair of opposing recesses 184 on the block 15. By utilizing detents 182, the tool 180 may easily be removed from the collar 14 so that it may be used simultaneously with the ratchet. The elongated tool 180, which has a U-shaped cross section, has a plurality of hexagonal apertures 186 for engaging an end of a fastener. An end 188 opposite the pivotal end 190 may include either a hexagonal bit 192 fixedly attached thereto (FIG. 20) or a socket 194 adapted to receive hexagonal bits (FIG. 18). For the embodiment including the socket 194, a corresponding circular recess 196 is oriented in the edge side 20 of the handle 12 to receive the socket 194 when the elongated tool 180 is rotated into the stored position.

Figure 21:
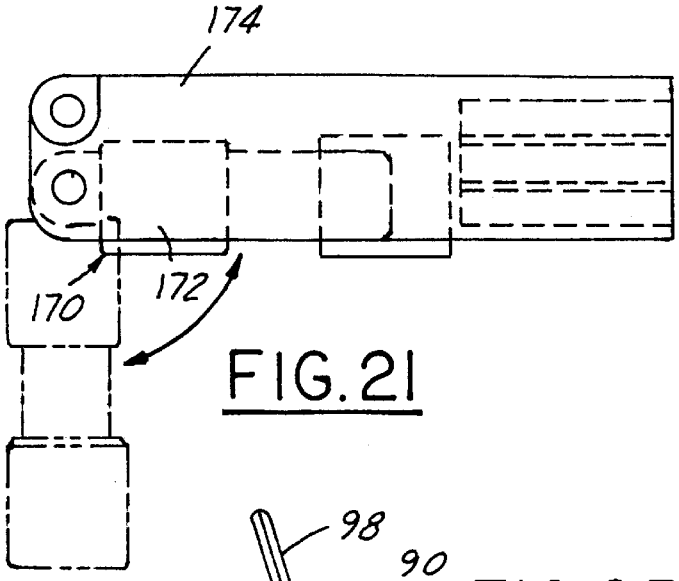
FIG. 21 is a side view of an additional embodiment of the invention.
Figure 22:
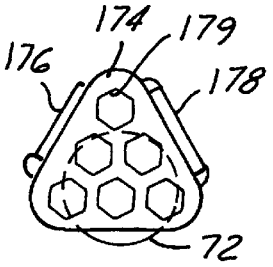
FIG. 22 is an end view of the tool shown in FIG. 21.
Figure 23:
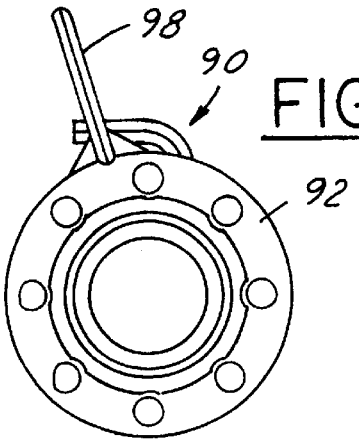
FIG. 23 is a side view of another embodiment according to the invention.
Figure 24:
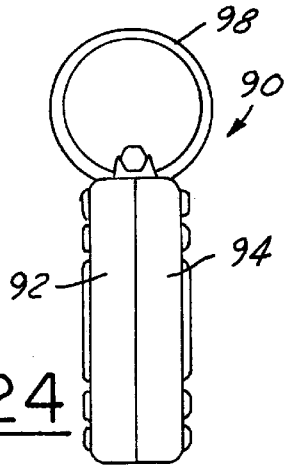
FIG. 24 is an end view of the tool shown in FIG. 23.
Figure 25:
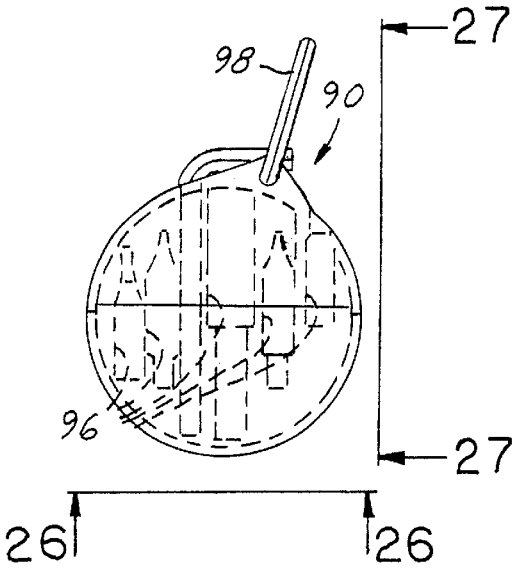
FIG. 25 is a side view of the tool shown in FIG. 23 illustrating an interior cavity of the tool and tool bits received therein.
Figure 27:
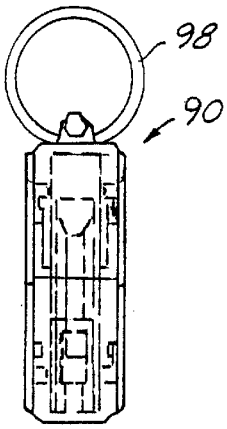
FIG. 27 is a cross-sectional view taken along lines 27—27 shown in FIG. 25.

FIGS. 21 an 22 illustrate an additional embodiment tool 170 having an arm 172 pivotally carried on a base 174 to permit folding the arm 172 to the position shown in FIG. 21 for storage, or pivotally unfolding of the arm 172 to incline it from the base 174 for use of a tool bit or socket on an end of the arm (as shown in phantom). The arm 172 may unfold to define an acute included angle with the base of between 0 to 180degrees. As shown in FIG. 22, one or more cavities 180 may be provided in the base 174 to store tool bits, sockets, wrenches, or specialty tools. A file 176 and specialty tool 178 may be stored in slots in the base 174.

FIGS. 23–27 illustrate an additional embodiment tool 90 having a generally circular periphery and opposed, mating upper and lower halves 92, 94, respectively that can be opened or closed with respect to each other. A threaded or bayonet connection is contemplated between the two halves.

The halves may be separated to expose one or more cavities 96 in which tool bits, sockets, wrenches or specialty tools may be received for storage. One or more of the cavities 96 may also be constructed to receive a tool bit for use as an operating handle for the tool bit when in use. Desirably, such cavities 96 in both the upper and lower halves permit engagement of both sides of a fastener with one tool bit in the upper half 92 and another tool bit in the lower half 94. The tool 90 may have a ring 98 to be received on a keychain.

Figure 28:
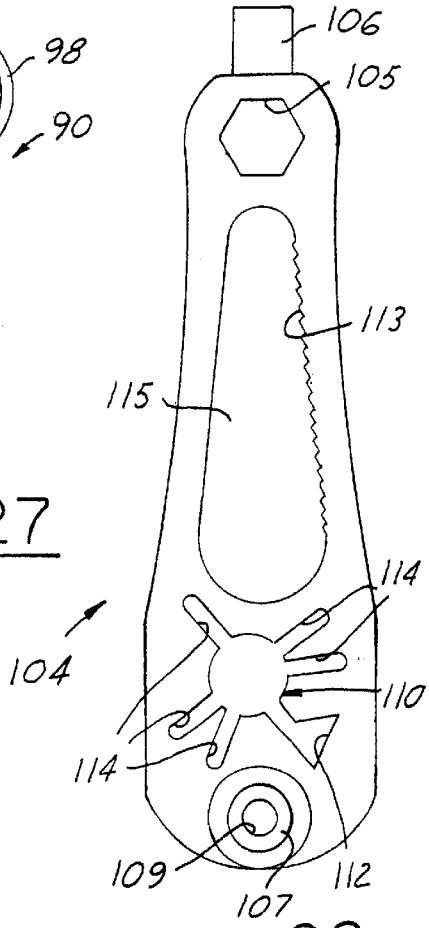
FIG. 28 is a top view of another modified specialty tool used with and stored on a tool according to the above mentioned embodiments of the invention and particularly useful in archery.
Figure 26:
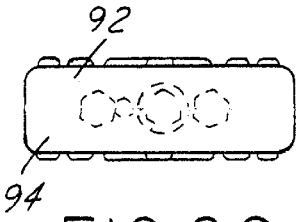
FIG. 26 is an end view of the tool shown in FIG. 23 viewed along line 26—26.

FIG. 28 illustrates another specialty tool 104 which may be received on the tools, in cavities of a tool or separately carried. The specialty tool 104 has a wrench cavity 105. Additionally, the specialty tool may have a stub end 106 useful for pushing tool bits and the like out of the recesses in the handle of the tool. Such stub end may be an allen wrench 108 of the like which is in and of itself useful as a tool to engage a fastener. Specifically, a contoured cavity 110 in specialty tool 104 has a triangular portion 112 useful to facilitate removal of a tip of an arrow and a plurality of slots 114 useful in holding the prongs of an arrow while removing an arrow head from a shaft or installing an arrow head onto a shaft. A tapped hole 107 with internal threads 109 is at one end to engage threads of an arrow head to remove from its implanted substrate. In addition a saw blade section 113 is also in an interior cavity 115 of the tool 104.

Figure 29:
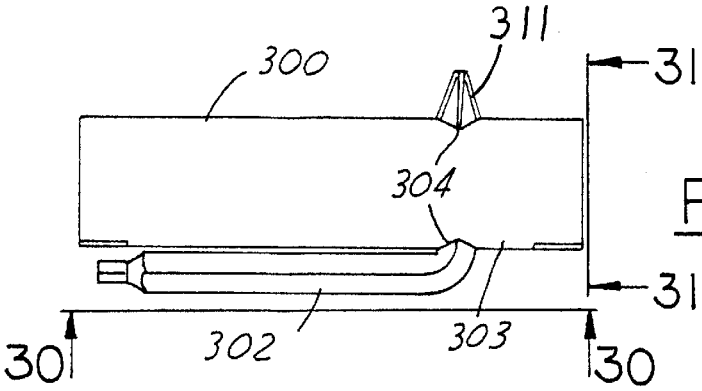
FIG. 29 is a side elevational view of a tubular embodiment of a two piece tool.
Figure 30:
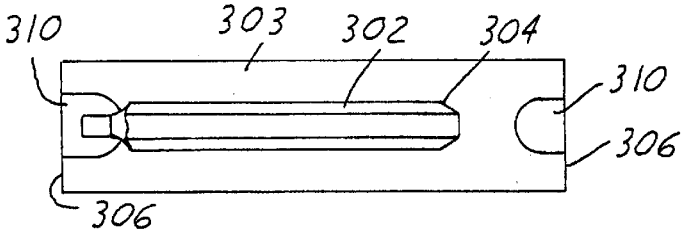
FIG. 30 is side view of the tool shown in FIG. 29 viewed along line 30—30.
Figure 31:
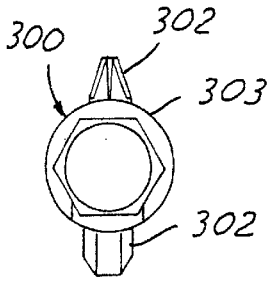
FIG. 31 is an end view of the tool shown in FIG. 29 viewed along line 31—31.
Figure 32:
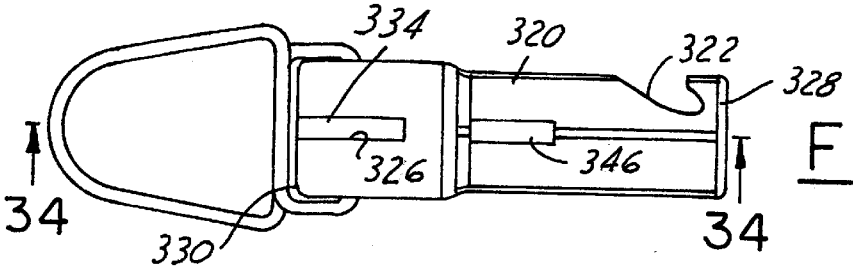
FIG. 32 is a side elevational view of another variation of the embodiment shown in FIG. 29.
Figure 33:
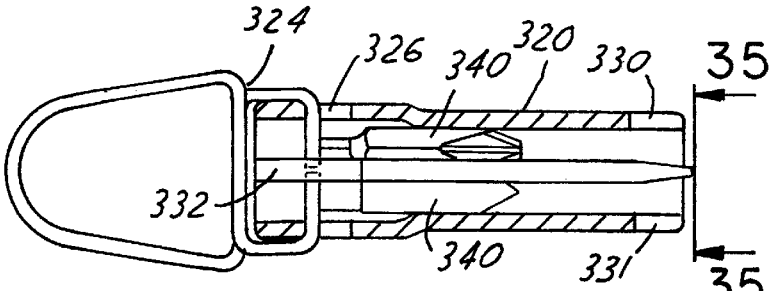
FIG. 33 is a segmented side elevational view of the tool shown in FIG. 32.
Figure 35:
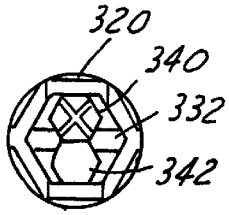
FIG. 35 is an end view of the tool shown in FIG. 32 viewed along line 35—35.
Figure 34:
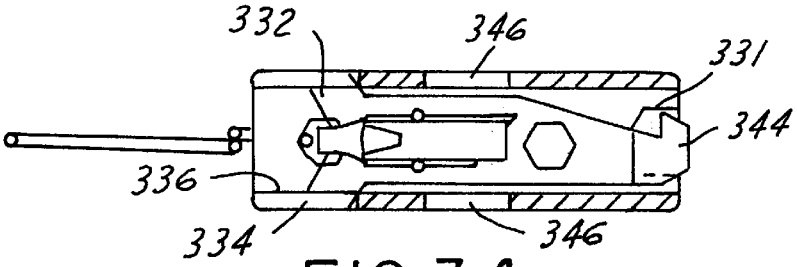
FIG. 34 is a cross-sectional view taken along lines 34—34 shown in FIG. 32.

Reference now is made to FIG. 29 which discloses a tubular tool 300 specifically adapted to have functions for repairing and adjusting a skateboard. A specialty tool steel bit member 302 having one end with a Philips screwdriver bit 311 and another end with a ⅛" hex to remove bolts that hold a truck to the deck is stored or mounted in a tubular housing 303. The bit is stored in two holes 304 in the side wall of the housing. The ends 306 oaf the tubular housing each has a 9⁄16" and ½" hex shaped wrench cavity 308 for receiving a nut of the skateboard wheels and king pin adjustment. The specialty bit 302 can be mounted in the opposing notches 310 for acting as a handle for the socket to provide added torque. In addition the notches are sized as ⅜" and ⅝" for the nut on the bottom of a skateboard truck. The member 302 can also act as a bearing pusher for seating bearing in the wheels when placed in holes 304 in a position 180 degrees from shown in FIG. 29.

A more versatile specialty tool with more parts and capabilities is shown in FIGS. 32–35. In this embodiment, the tubular housing 320 has a bottle cap remover notch 322 at its side. A spring loaded key ring 324 has it clip end mounted through two side holes 326. When clipped in holes 326, the key ring 324 also retains an flat wrench member 332 that has large socket end 334 received in opposing slots 336. This socket end 334 will adjust most king pin nuts on a skateboard truck. The wrench also has a cavity 338 that is used to hold two ¼" double ended bits 340 and 342. Bit 340 is a Phillips head and ⅛" hex head while bit 342 is a cutter blade and 7⁄32" hex head. The other end of the flat wrench member 332 has a bearing puller 344. The bearing puller is used by placing the wrench 332 through center slots 346 which is retained by the large socket end 334. The housing 320 is then used as a pull handle for puller 344.

The tubular housing is stepped to have each end with a ⅜" open wrench lot 330 and 8 mm open wrench slot 331. The apertures 326 may have a hex shape of a desired size for use as a hex wrench.

Figure 36:
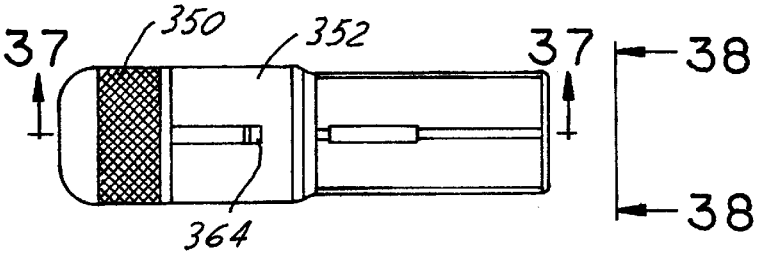
FIG. 36 is a side elevational view of another variation of the embodiment shown in FIG. 29.
Figure 37:
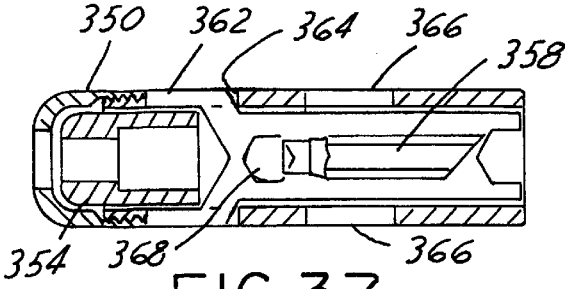
FIG. 37 is a segmented side elevational view of the tool shown in FIG. 36.
Figure 38:
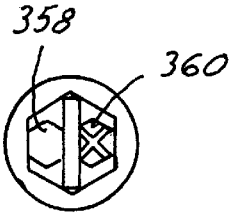
FIG. 38 is an end view of the tool shown in FIG. 36 viewed along line 38—38.

The embodiment shown in FIGS. 36–38 has a screw top 350 that threadably engages stepped hex shaped housing 352 and stores a socket member 354 and a flat wrench member 356 and two bits members 358 and 360. The flat wrench member has its large 9⁄16" socket end 362 received in open slots 364 and small 45⁄16" socket end 366 in the housing. A ¼" inch socket opening 368 is in the midsection. The wrench when in use may be inserted in slots 366 of the housing if so desired. The end opposite of the cap of the housing has a ½" socket which can be used with wrench member 356 used as an operating handle when extended through slots 366. The ⅜" socket member can be used by having bit 358 linking it to flat wrench member through the socket opening 368.

In this fashion, a multi-function portable tool is easily transports and can be easily used for a variety of functions.

Other variations and modifications are possible without departing from the scope and spirit of the present invention as defined by the appended claims.

The embodiments in which an exclusive property or privilege is claimed are defined as follows:

1. A hand held tool having a main body with a handle section and a rotatable tool chuck operably attached to the body at a distal end of a longitudinally extending section of the main body from the handle section; the hand held tool comprising:

said main body having a receiving cavity for removably receiving and storing a first tool element thereon where the first tool element extends besides the longitudinally extending section toward the tool chuck along an exterior of said hand held tool;

said chuck constructed to removably mount both a male tool bit and a female socket tool;

said chuck selectively rotatable with respect to said handle section;

said chuck having an outer wall with two pairs of parallel sections, one substantially transverse to the other, that is configured in cross section forming a male mounting end for operably mounting a female first section of said socket tool such that said socket tool can be selected to be in a working position or a storage position; said chuck having an inner wall surface of a different share configured in cross section forming a female receiving section for operably receiving a said tool bit when the socket tool is in said storage position.

2. A hand held tool as defined in claim 1 further comprising:

said receiving cavity being in the form of a hole for receiving an allen wrench therethrough.

3. A hand held tool as defined in claim 1 further comprising:

said receiving cavity being shaped to receive and store a wrench tool along the main body;

said handle having a star-shaped recess for storing a tool bit, said tool bit having at least one ear for acting as a stop when inserted into an aperture on said wrench tool to allow pressure to be applied to said bit.

4. A hand held tool as defined in claim 3 further comprising:

said wrench tool having a recessed notched bottle opener built into it.

5. A hand held tool having a main body with a handle section and a rotatable tool chuck operably attached to the body at a distal end of a longitudinally extending section of the main body from the handle section; the hand held tool comprising:

said main body having a receiving cavity for removably receiving and storing a first tool element thereon where the first tool element extends besides the longitudinally extending section toward the tool chuck along an exterior of said hand held tool;

said chuck selectively rotatable with respect to said handle section;

said handle section being transverse to said longitudinally extended section;

said receiving cavity being in the form of an elongated recess extending along the longitudinally extended section for receiving a long section of an allen wrench and a hole for receiving a short section of said allen wrench.

6. A hand held tool as defined in claim 5 further comprising:

said handle having a hollow interior for storing tools therein and said hole extending to said cavity for providing said alien wrench to extend through said storage hollow interior.

7. A hand held tool having a main body with a handle section and a rotatable tool chuck operably attached to the body at a distal end of a longitudinally extending section of the main body from the handle section; the hand held tool comprising:

said main body having a receiving cavity for removably receiving and storing a first tool element thereon where the first tool element extends besides the longitudinally extending section toward the tool chuck along an exterior of said hand held tool;

said chuck selectively rotatable with respect to said handle section;

said receiving cavity being shaped to receive and store a wrench tool along the main body;

said handle having a star-shaped recess for storing a tool bit, said tool bit having at least one ear for acting as a stop when inserted into an aperture on said wrench tool to allow pressure to be applied to said bit;

said wrench tool having a cavity therein with a saw blade edge;

said wrench tool having a tapped hole for engaging a threaded arrow head.

8. A hand held tool having a main body with a handle section and a rotatable tool chuck operably attached to the body at an end distal from the handle section for selective rotation with respect to said handle; the hand held tool comprising:

said chuck constructed to removably mount both a male tool bit and a female socket tool;

said chuck having an outer wall with two pairs of parallel sections, one substantially transverse to the other, that is configured in cross section forming a male mounting end for operably mounting a first female section of said socket tool such that said socket tool can be selected to be in a working position or a storage position; said chuck having an inner wall surface of a different shape configured in cross section forming a female receiving section for operably receiving said tool bit when the socket tool is in said storage position.

9. A hand held tool as defined in claim 8 further comprising:

said handle section having a recessed notched bottle opener built into a distal end thereof.

10. A hand held tool as defined in claim 8 further comprising:

said handle section having cavities for receiving and storing socket members.

11. A hand held tool as defined in claim 8 further comprising:

said handle member having an extension pivotably attached thereto for pivoting outwardly and providing extra torque turning ability to the handle.

12. A hand held tool as defined in claim 8 further comprising:

said handle having a blade sharpener built into an end thereof.

13. A hand held tool comprising:

a tubular body with a bit storably and directly mounted on said tubular body;

said tubular body having a receptor for receiving a first tool element in an operating position with said tubular body being used as a operable handle for said tool;

said tubular body being stepped with a larger end and a smaller end;

a flat wrench member sized to fit within aid tubular body and having a large end stepped to not intrude into the small end of the tubular body;

a stop member attachable to said larger end of the tubular body for retaining said flat wrench within the tubular body.

14. A hand held tool as defined in claim 13 further comprising:

said stop member being a resilient spring key ring member.

15. A hand held tool as defined in claim 13 further comprising:

said stop member being a cap member attachable to said larger end of said tubular member for retaining said flat wrench within the tubular member;

a socket member being stored in said tubular member between said wrench member and said cap member.

16. A hand held tool as defined in claim 13 further comprising:

said flat wrench member having a cavity for retaining at least one bit therein when stored within said tubular body;

said tubular body having opposing slots at an end thereof for receiving the large end of said flat wrench member during storage and having slots at a mid section thereof for receiving a narrower section of said flat wrench member during usage thereof to function as an operable handle member.

17. A tool having a chuck operably attached at a proximate end thereof to a body of said tool for being selectively rotatable thereto;

said chuck constructed to removably mount both a male tool bit and a female socket member;

said chuck having an outer wall with two pairs of parallel sections, one substantially transverse to the other, that is configured in cross-section forming a male mounting end for operably mounting a first female section of said socket tool in a working position from a distal end of said chuck;

said chuck having an inner wall surface of a different shape configured in cross-section forming a female receiving section for operably receiving said tool bit therein from said same distal end.

18. A tool as defined in claim 17 further characterized by:

said inner wall surface and said outer wall both extend to said distal end of said chuck.

19. A tool as defined in claim 18 further characterized by:

said outer wall of said chuck being substantially square and said inner wall being substantially hexagonal in shape.

20. A tool assembly having a tool with a chuck operably attached at a proximate end thereof to a body of said tool for being selectively rotatable thereto;

a tool bit having a first mounting section that is non-circular;

a socket tool having a first mounting section and a second socket section;

said chuck constructed to removably mount both said tool bit which is male and said socket tool which is female;

said chuck having an outer wall configuration with two pairs of parallel sections, one substantially transverse to the other, for operably mounting said first section of said socket tool from a distal end of said chuck;

said chuck having an inner wall surface of a different shape configured in cross-section for operably receiving said tool bit therein from said distal end of said chuck.

* * * * *